United States Patent [19]

Wang et al.

[11] Patent Number: 4,927,379

[45] Date of Patent: May 22, 1990

[54] ELECTRICAL CONNECTOR

[75] Inventors: Patrick S. Wang; Georg Strobl; Raymond W. H. Chu, all of Hong Kong, Hong Kong

[73] Assignee: Johnson Electric Industrial Manufactory, Limited, Chaiwan, Hong Kong

[21] Appl. No.: 233,756

[22] Filed: Aug. 19, 1988

[30] Foreign Application Priority Data

Aug. 20, 1987 [GB] United Kingdom ..... 8719715
Oct. 1, 1987 [GB] United Kingdom ..... 8723021

[51] Int. Cl.[5] ..... H01R 4/24
[52] U.S. Cl. ..... 439/398
[58] Field of Search ..... 439/398–424

[56] References Cited

U.S. PATENT DOCUMENTS 2,694,189 11/1954 Wirsching ..... 439/399
4,261,629 4/1981 Reynolds et al. ..... 439/399
4,575,173 3/1986 Chapin et al. ..... 439/398

*Primary Examiner*—Joseph H. McGlynn
*Attorney, Agent, or Firm*—Fleit, Jacobson, Cohn, Price, Holman & Stern

[57] ABSTRACT

The connector, for example, is in the form of a terminal portion of a commutator segment and has two overlying parts. Each part is provided with a slot open at one end and the two slots are arranged so as to be only partly in register with one another so that the resulting slot in the terminal portion is narrower than each of the slots in the two overlying parts and is open at one end for receiving and gripping an armature winding portion. Non-aligned regions (as considered in a direction perpendicular to the plane of each overlying part) bordering the slots of the two overlying parts are offset, e.g. part sheared, out of the plane of the respective part towards the other part.

11 Claims, 2 Drawing Sheets

ELECTRICAL CONNECTOR

SUMMARY OF THE INVENTION

The present invention seeks to mitigate this drawback not only in commutator segments, but also in other types of electrical connector According to the present invention there is provided an electrical connector having two overlying parts, each part being provided with a slot open at one end and the two slots being arranged so as to be only partly in register with one another so that the resulting slot in the connector is narrower than each of the slots in the two overlying parts and is open at one end for receiving and gripping a wire, non-aligned regions (as considered in a direction perpendicular to the plane of each overlying part) bordering the slots of the two overlying parts being offset, e.g. part sheared, out of the plane of the respective part towards the other part.

Preferably, the two overlying parts are integrally connected at a fold line extending transversely of the longitudinal extent of the said resulting slot.

Advantageously, said non-aligned regions are half-sheared out of the plane of the respective part and the two overlying parts are in contact or closely adjacent to one another so that said regions lie in, or substantially in, a common plane.

Other preferred and/or optional features of the invention are set forth in claims 5, 6 and 7.

Conveniently, the connector forms a terminal portion of a commutator segment and serves to connect an armature winding portion to the commutator segment. However, the connector could take other forms. For example, it could slidably connect with a terminal to connect a wire thereto.

The invention will now be more particularly described by way of example with reference to the accompanying drawings.

DESCRIPTION OF THE PREFERRED EMBODIMENT

Figure 1:
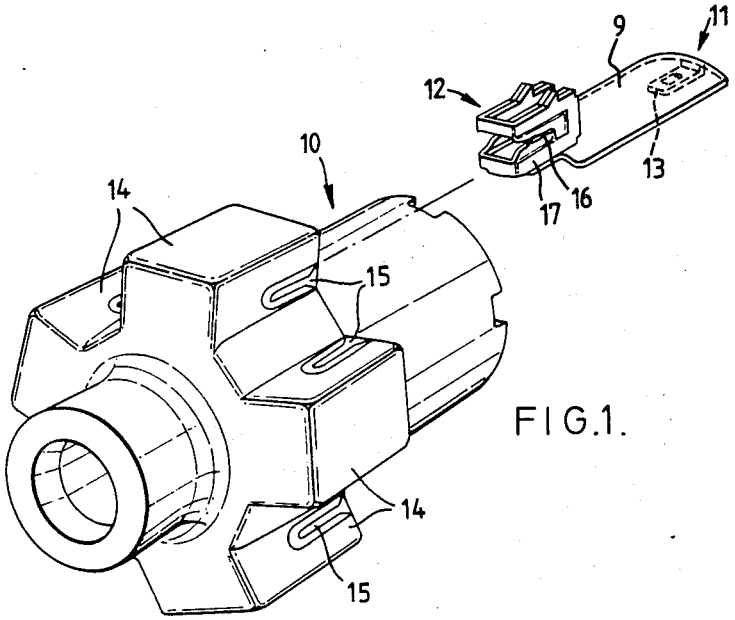
FIG. 1 is an exploded perspective view of a commutator provided with commutator segments (only one shown) embodying the invention.

Referring first to FIG. 1 of the drawing, there is shown therein a commutator base 10 and a commutator segment 11. The segment 11 has an electrical connector in the form of an integral terminal portion 12 at one end and an integral lug 13 at its other end with a brush contacting portion 9 therebetween. The base 10 has at one end an integral rose-like arrangement of five housings 14 each provided internally with a central boss (not shown) upstanding from the base of the housing.

In assembling this commutator, an armature winding portion is located in an aligned pair of slots 15 in each housing so as to be supported by the closed ends of the slots 15 and a respective boss. The commutator segments (only one shown) are then moved in a direction parallel to the axis of the base 10 so that the terminal portions 12 move into respective housings 14 and the lugs 13 move into respective recesses in the end of the base remote from the housings. Slots 16 in parallel arms 17 of the terminal portions 12 have cutting edges which strip insulation from the winding portions as the slots 16 move thereover and the slots then straddle and grip the core of the winding portions to establish and maintain electrical contact between the winding portions and respective terminal portions 12.

Figure 4:
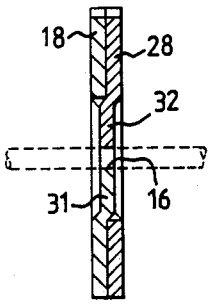
FIG. 4 is a section taken along line IV—IV of FIG. 3 on an enlarged scale.
Figure 3:
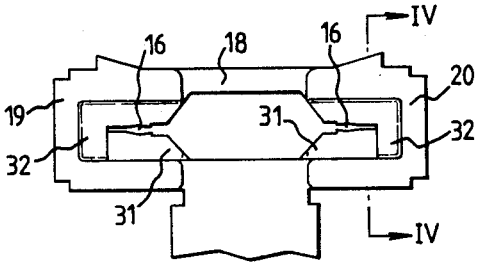
FIG. 3 is an enlarged plan view of part of the commutator segment of FIG. 2 shown partly formed.
Figure 2:
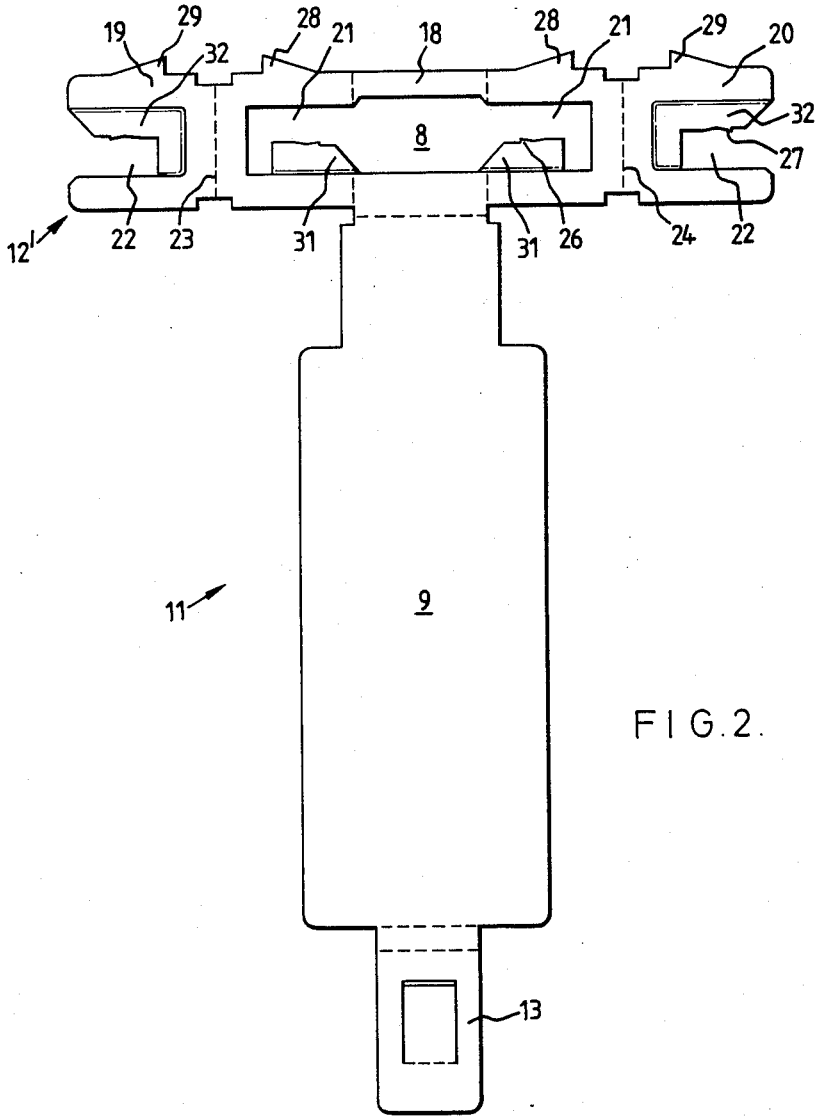
FIG. 2 is an enlarged plan view of one embodiment of a commutator segment embodying the invention, in blank form.

Each arm 17 comprises two overlying parts as more particularly shown in FIGS. 2, 3 and 4.

The terminal portion 12 of the commutator segment blank shown in FIG. 2 is generally rectangular with its minor axis coincident with the longitudinal axis of the brush contacting portion 9 of the commutator segment. The terminal portion 12 comprises a central part 18 and two end parts 19 and 20. The central part 18 has a central cut out portion 8 which reduces from its largest width at the centre to two elongate slots 21 which terminate either end of the cut out. Each end part 19, 20 also has an elongate slot 22 which, when the end part 19, 20 is folded about fold line 23, 24, respectively, to overlie the central part 18 (as shown in FIG. 3), comes only partly into register with the respective slot 21 in the central part 18.

Thus, the resulting slot 16 (FIGS. 1 and 3) on each side of the terminal portion is narrower than each of the slots 21 and 22.

Non-aligned regions (as considered in a direction perpendicular to the plane of each overlying part) 31 and 32 bordering the slots 21 and 22, respectively, of the two overlying parts 18 and 19 and the two overlying parts 18 and 20 are offset out of the plane of the respective part towards the other of the two overlying parts. This is most clearly seen in FIGS. 3 and 4. The regions 31 and 32 interlock with non offset regions, as best shown in FIG. 4, to prevent movement of the end parts 19 and 20 with respect to the central part 18.

The offset of the respective non-aligned regions is effected by a part-shearing operation and preferably the regions 31 and 32 are half sheared out of the plane of the respective part 18, 19, 20 so that when the overlying parts 18 and 19 and the overlying parts 18 and 20 are in contact or closely adjacent to one another as for example shown in FIG. 4 the regions 31 and 32 of each arm 17 lie in a common plane to define the resulting slot 16.

Two cutters 26 and 27 having sharp cutting edges project into each slot 16 the cutter 26 being provided on the region 31 of the central part 18 and the cutter 27 being provided on the region 32 of the end part 19, 20. The cutting edges on the cutters 26 and 27 are for stripping insulation from the winding portions as previously described.

The closed end of the slot 16 is enlarged to ensure that the edges of the slot 16 have a certain resilience to separation by the winding.

A triangular barb 28 is provided on either side of the minor axis of the central part 18 along the edge furthest from the commutator segment. Barbs 29 on the end parts 19 and 20 register with barbs 28 when the end parts 19 and 20 are folded to overlie the central part 18 as shown in FIG. 3 and these barbs 28 and 29 grip the housing 14 (FIG. 1) and therefore retain the terminal portion 12 in the housing 14.

The brush contacting portion 9 of the commutator segment is of arcuate form to conform to the external radius of the commutator base 10. The terminal portion 12 is bent upright from the commutator segment 11 and the central part 18 of the terminal portion is bent at 90° in areas 30 to form the arms 17 (FIG. 1) which extend parallel to each other and to the longitudinal axis of the commutator segment 11, and forward along the length thereof.

The above embodiment is given by way of example only and various modifications will be apparent to persons skilled in the art without departing from the scope of the invention defined by the appended claims.

For example, the terminal portion 12 may be designed with only one arm 17 or may have more than two arms 17. Instead of the barrel commutator shown, the commutator may be a face commutator with the commutator segments arranged in a single plane perpendicular to the axis of the armature. Furthermore, the winding portions may be pre-stripped of insulation thus avoiding the need to provide the cutters 26 and 27.

Also the electrical connector could take a form other than an integral terminal of a commutator segment. For example, the connector could be in the form of a device for connecting a wire to a terminal, the device being adapted to slidably connect with the terminal and having a slot formed in the manner described herein which straddles and grips a wire as the device is connected to the terminal.

What is claimed is:

1. An electrical connector formed from sheet material folded to provide two overlying parts, each part having a slot open at one end, the open ends of the slots being adjacent and the two slots being arranged so as to be only partly in register with one another so that the resultant slot in the connector is narrower than each of the slots in the two overlying parts and is open at one end for receiving and gripping a wire, non-aligned regions (as considered in a direction perpendicular to the plane of each overlying part) bordering the slots of the two overlying parts, the non-aligned regions defining the resultant slot being offset by a part-shearing out of the plane of the respective part towards the other part so that the non-aligned regions are substantially co-planar.

2. A connector as claimed in claim 1, wherein the two overlying parts are formed by folding about a fold line extending transversely of the longitudinal extent of the resultant slot.

3. A connector as claimed in claim 1, wherein the connector has at least two spaced parallel arms each comprising two overlying parts with slots therein.

4. A connector as claimed in claim 1, having a barb for retaining the connector in a housing.

5. A connector as claimed in claim 1, wherein the resultant slot in the connector has two cutting edges for cutting through insulation of an insulated wire as the wire is drawn into the slot in the connector thereby to establish electrical contact between the wire and the connector, one cutting edge being provided by an edge of the slot in one of the two overlying parts and the other cutting edge being provided by an edge of the slot in the other of the two overlying parts.

6. A commutator segment for an armature of an electric motor, the commutator segment comprising a brush contacting portion and a connector, the connector having two overlying parts, each part being provided with a slot open at one end, the open ends of the slots being adjacent and the two slots being arranged so as to be only partly in register with one another so that the resultant slot in the connector is narrower than each of the slots in the two overlying parts and is open at one end for receiving and gripping a wire, non-aligned regions (as considered in a direction perpendicular to the plane of each overlying part) bordering the slots of each of the two overlying parts, the non-aligned regions defining the resultant slot being offset by a part-shearing out of the plane of the respective part towards the other part so that the non-aligned regions are substantially co-planar.

7. A commutator for an armature of an electric motor, comprising a commutator base, a plurality of commutator segments each as claimed in claim 6, and means securing each segment on the base.

8. An electric motor having a commutator as claimed in claim 7.

9. A commutator for an electric motor, the commutator comprising a base and a plurality of commutator segments mounted on the base, the commutator segments each comprising a brush-contacting portion and a connector portion, the base supporting the brush-contacting portions of the commutator segments and having a plurality of housings which house the commutator segment terminal portions, wherein each said terminal portion has a slot which, in use, straddles and grips an armature winding portion, said slot being defined by two opposed edges which are formed on respective substantially planar metal portions of said terminal portion, said metal portions overlying one another and the region of each said edge in each said metal portion being deformed out of the plane of said metal portion towards the plane of the other said metal portion, whereby said regions are substantially co-planar.

10. A commutator for an electric motor, the commutator comprising a base and a plurality of commutator segments mounted on the base, the commutator segments each comprising a brush-contacting portion and a connector portion, the base supporting the brush contacting portions of the commutator segments and having a plurality of housings which house the commutator segment terminal portions, each terminal portion comprising a double layer of material which defines a resultant slot for straddling and gripping an armature winding portion, each layer of material having therein a slot which is open at one end, the open ends of the slots being adjacent each other and the slots being out of register when viewed in a direction transverse to the plane of the material layers, the arrangement being such that the resultant slot is defined by a first edge of a slot in a first layer and a second edge of a slot in a second layer, wherein the material of each layer in the region of the respective first and second edges is part-sheared out of the plane of the respective layer towards the other layer, such that the first and second edges are substantially co-planar.

11. A commutator as claimed in claim 10, wherein the first and second layers are formed by folding over the material of the terminal portion.

* * * * *